United States Patent [19]

Whitfield

[11] Patent Number: 4,787,322

[45] Date of Patent: Nov. 29, 1988

[54] PELLET FEED SYSTEM

[76] Inventor: Oliver J. Whitfield, 4206 242nd St., S.W., Mountlake Terrace, Wash. 98043

[21] Appl. No.: 161,003

[22] Filed: Feb. 26, 1988

[51] Int. Cl.[4] ..... F23K 3/10

[52] U.S. Cl. ..... 110/266; 110/110; 110/327; 414/197; 414/326

[58] Field of Search ..... 110/267, 286, 287, 288, 110/281, 282, 283, 292, 327, 101 R, 102, 110; 414/160, 172, 187, 190, 197, 325, 326

[56] References Cited

U.S. PATENT DOCUMENTS

| | | | |
|---|---|---|---|
| 724,482 | 4/1903 | MacCormack | 110/283 |
| 2,262,078 | 11/1941 | Yasick | 110/288 |
| 2,342,796 | 2/1944 | Elliott | 110/287 |
| 3,149,625 | 9/1964 | Margetts | 126/110 |
| 3,311,074 | 3/1967 | Margetts | 110/ |
| 3,365,812 | 1/1968 | Borrow | 414/326 X |
| 4,007,697 | 2/1977 | Prill | 110/ |
| 4,323,017 | 4/1982 | Harris | 110/110 |
| 4,430,948 | 2/1984 | Schafer et al. | 110/101 R |
| 4,449,462 | 5/1984 | Robb | 110/288 |
| 4,455,111 | 6/1984 | Jackson et al. | 406/56 |
| 4,520,740 | 6/1985 | Carpenter | 110/288 |
| 4,548,194 | 10/1985 | Schafer et al. | 126/110 R |
| 4,565,184 | 1/1986 | Collins et al. | 126/368 |
| 4,574,712 | 3/1986 | David | 110/288 |
| 4,619,209 | 10/1986 | Traeger et al. | 110/110 |
| 4,705,443 | 11/1987 | Teske | 414/197 X |

FOREIGN PATENT DOCUMENTS

| | | | |
|---|---|---|---|
| 2093585 | 9/1982 | United Kingdom | 110/288 |

*Primary Examiner*—Steven E. Warner

*Attorney, Agent, or Firm*—Christensen, O'Connor, Johnson & Kindness

[57] ABSTRACT

A stoker assembly for a solid particulate burning stove that includes a fuel directing flange for directing the fuel to an upper combustion plate and ventilation tubes to prevent the ignition and combustion of fuel stored in remote bins. The fuel directing flange serves to prevent the solid particulate fuel from falling back into the auger conveyor and being ground into smaller particulate matter.

10 Claims, 3 Drawing Sheets

PELLET FEED SYSTEM

BACKGROUND OF THE INVENTION

The present invention relates to heaters that utilize particulate solid materials as fuel. More particularly, the present invention is concerned with a stoker assembly for feeding such particulate material to the burner of the heater.

Heaters with some means of feeding combustible particulate material thereto are well known and often referred to as stoker-type heaters. Typically, such stoker-type heaters have been utilized with pulverized coal or some similar combustible particulate material as a fuel source. Such heaters were later replaced by oil or gas-fired heaters when gas and oil were in plentiful supply. Because of increasing costs of gas and oil fuel, attention again is being directed to wood-burning heaters that burn wood or other types of combustible residue. Presently, particular attention is being given to heaters of the type that use preprocessed pelletized fuel sources produced from wood waste, agricultural residue and the like.

A stoker-type heater basically consists of a reservoir for containing the fuel supply, a feed means for conveying the combustible fuel supply from the supply container to the burner in the combustion chamber of the heater and an air supply for use in combustion of the combustible fuel.

In using preprocessed pelletized feed fuel, there are a number of problems that must be overcome that are not encountered when using conventional type fuel supply such as coal or wood chips. The pelletized fuel is prepared by compacting wood waste, agricultural residue, paper, coal dust, or garbage into discrete particles. Such discrete pelletized particles are generally not processed in a manner that results in a pellet which has high structural integrity. Therefore, care must be taken when the pellets are conveyed to the burner of the combustion chamber, not to subject the pellets to any unnecessary movement other than that required to move the pellets from the fuel supply to the combustion chamber. Of particular concern, are systems that utilize a rotary type conveying means whereby the pelletized fuel may be easily ground or crushed up into a powdery residue by the conveying means. The pellets are particularly susceptible to grinding and crushing when they are being introduced into the combustion zone because the pellets may fall back down into the conveying means.

Another problem not specific to preprocessed pelletized fuel is the danger of "burn back" that occurs when the fire on the burner head penetrates upstream through the fuel supply system to the fuel storage bins. One method of addressing this problem incorporates a dual feed system with a "fire break" separating the systems to prevent the burn back. These designs are often cumbersome and expensive. Additionally, there is always a chance that a burn back of intense magnitude could jump the fire break and ignite the fuel storage bins.

Therefore, it is an object of the present invention to provide a feed supply means whereby small pelletized fuel particles can be efficiently and safely transported from a storage chamber to a combustion chamber without being susceptible to burn back or subjected to undesirable crushing or grinding conditions.

SUMMARY OF THE INVENTION

The present invention is a stoker assembly for a solid particulate fuel burning stove having a combustion chamber and separate fuel storage bins. The stoker assembly includes a fuel conveyor means having a casing with first and second fuel inlets adjacent each end of the casing. A fuel outlet zone is intermediate the fuel inlets. A rotatably driven auger is disposed within the casing to move fuel from the first and second fuel inlets to the fuel outlet zone. The auger includes a first helical flight and a second helical flight of opposite hand. The first helical flight is intermediate the first fuel inlet and the fuel outlet zone and the second helical flight is intermediate the second fuel inlet and the fuel outlet zone. The adjacent ends of the helical flights in the fuel outlet zone are spaced apart, with fuel directing paddles located intermediate the adjacent ends of the first and second helical flights. Alternatively, the ends of the helical flights opposite the fuel inlets are joined to provide another means of directing the fuel.

The stoker assembly further incudes an air housing having an inner wall defining a vertical fuel channel for passage of fuel from a lower fuel channel inlet zone through the fuel channel to a combustion plate at the top of the air housing. The fuel channel inlet zone communicates between the fuel outlet zone of the casing and the fuel channel.

The stoker assembly also includes a fuel guiding member for directing a portion of the fuel in the fuel outlet zone of the casing into the fuel inlet zone of the fuel channel. The fuel guiding member is a flange disposed on the interior surface of the casing at the interface between the fuel outlet zone and the fuel channel inlet zone. The fuel guiding member extends from the casing in a direction opposite the fuel flow created by the fuel directing paddles.

The stoker assembly optionally includes a channel communicating between the combustion chamber and the fuel storage bins to minimize the pressure difference along the conveyor system. By minimizing this pressure difference the burn back from the combustion chamber to the fuel storage bins can be safely and positively controlled.

The present invention provides a stoker assembly that safely provides fuel from remote storage bins to a combustion plate. The stoker assembly does not suffer from the drawback of exiting fuel falling back into the auger conveyor and therein being ground into smaller particulate matter or from burn back dangers that accompany conventional stoker assemblies.

BRIEF DESCRIPTION OF THE DRAWINGS

The present invention will become more apparent from the following description herein when considered together with the accompanying drawings. Such drawings are set forth as being merely illustrative of the invention and are not intended in any way to be limitative thereof. It is to be understood that modifications and changes in the preferred embodiments of the invention herein described and shown may be made without departing from the spirit and scope of the present invention.

DETAILED DESCRIPTION OF THE INVENTION

Figure 2:
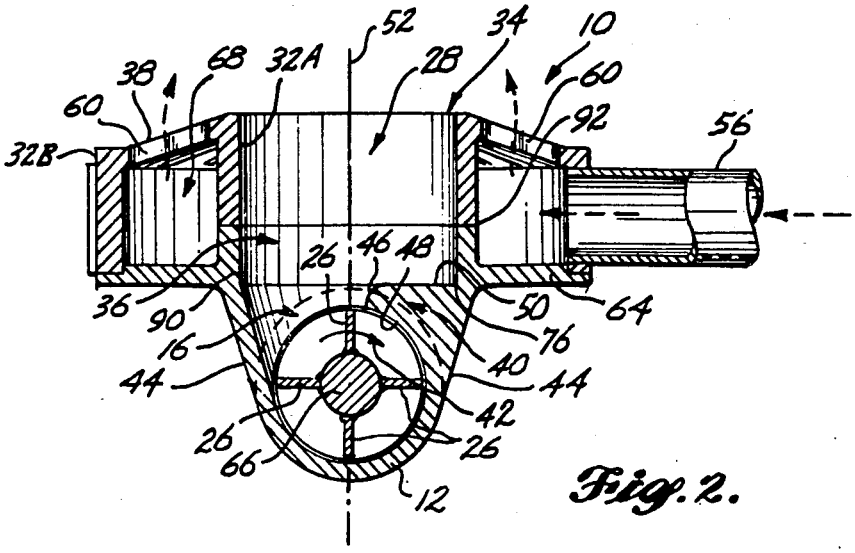
FIG. 2 illustrates a cross-sectional side view of the stoker assembly in accordance with the present invention.
Figure 1:
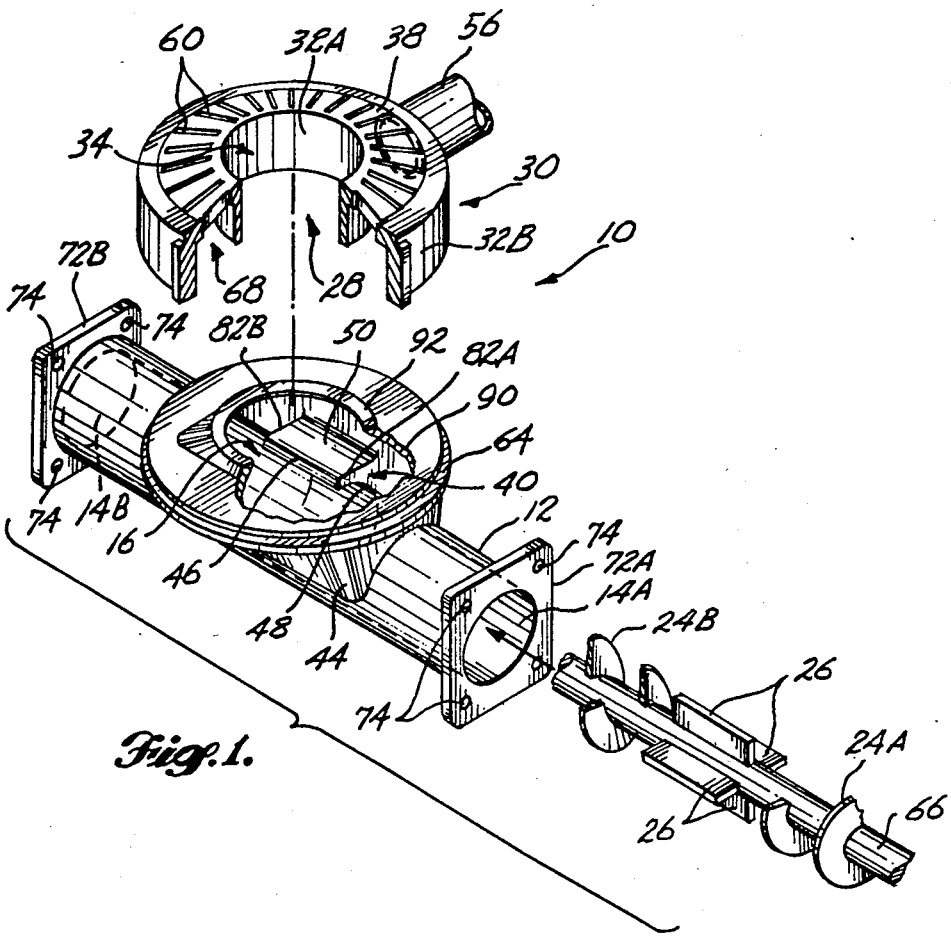
FIG. 1 illustrates an exploded isometric view of the stoker assembly in accordance with the present invention, with a portion cut-away.
Figure 3:
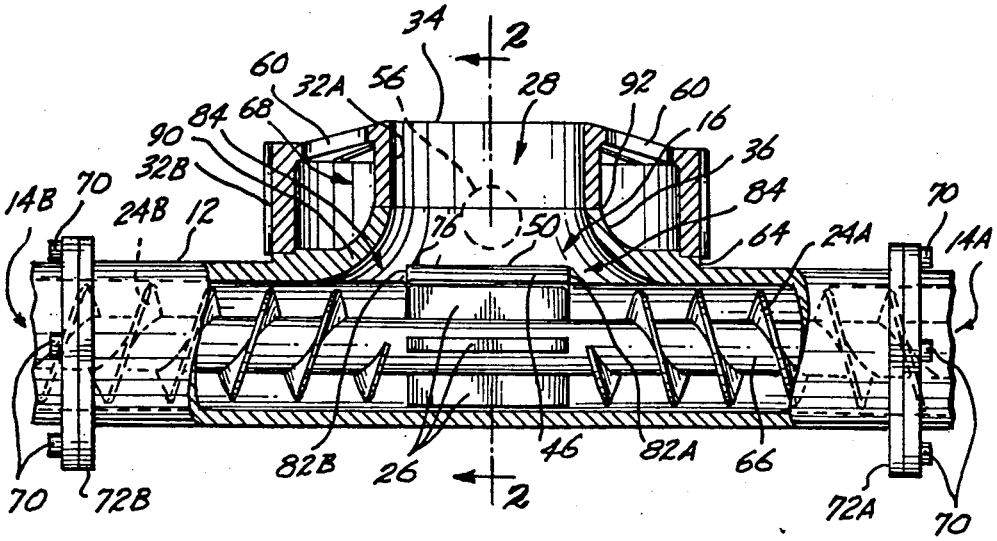
FIG. 3 illustrates a front, partial cut-away view of the stoker assembly in accordance with the present invention.

Referring primarily to FIG. 1, the stoker assembly 10 includes an air housing 30, an air housing set 64, a conveyor casing 12, a fuel guide 40, an auger 18, and fuel directing paddles 26. The conveyor casing is a longitudinal tube having an inside and an outside surface, and a diameter ranging from about 2 to about 6 inches, preferably about 2.5 to about 3.5 inches. the conveyor casing 12 includes a first 14A and second 14B fuel inlet located on opposing ends of the conveyor casing 12. Adjacent the first and second fuel inlets 14a and 14B are a first and second connecting bulkheads 72A and 72B, that allow the conveyor casing 12 to be secured to a fuel supply (not shown). Referring additionally to FIGS. 2 and 3, intermediate the first 14A and second 14B fuel inlets, disposed in the upper half of the conveyor casing 12 is a fuel outlet zone 16 that allows the inside surface of the conveyor casing 12 to communicate with the outside surface of the conveyor casing 12. The absence of a central portion of the upper half of the conveyor casing 12 intermediate the first and second fuel inlets 14A and 14B defines the fuel outlet zone 16.

Still referring to FIGS. 1, 2 and 3, directly above and encompassing the fuel outlet zone 16 is a jacket 44 that supports an air housing set 64 above the conveyor casing 12 directly over the fuel outlet zone. The air housing seat 64 is a circular plate having a top and bottom surface positioned horizontally above the removed portion of the conveyor casing 12 that defines the fuel outlet zone 16. The jacket 44 that supports the air housing seat 64 above the conveyor casing 12 includes an upper boundary defined by the lower surface of the circular air housing seat 64 and a lower boundary defined by the top half of the conveyor casing 12 that the jacket 44 encompasses. The vertical boundaries of the jacket 44 are defined by the vertical walls between the circular upper boundary and the lower boundary of the jacket 44. The jacket 44 for supporting the air housing seat 64 is constructed so that it cooperates with the top of the conveyor casing 12 and the bottom of the circular air housing seat 64, thus allowing the air housing seat 64 to be mounted above the top of the conveyor casing 12.

In FIGS. 1, 2 and 3, the top surface of the air housing seat 64 includes a fuel channel inlet zone 36 that has a lower rectangular entry 90 and an upper circular exit 92. The vertical boundaries of the fuel channel inlet zone 36 are defined by the walls that connect the lower rectangular entry 90 of the fuel channel inlet zone 36 and the upper circular exit 92 of the fuel channel inlet zone 36.

In FIGS. 1, 2 and 3 a circular annular air housing 30 resides on the top surface of the air housing seat 64 and the upper circular exit 92 of the fuel channel inlet zone 36. The air housing 30 includes an annular air channel 68 defined by the outer vertical wall 32B and inner vertical wall 32A of the air housing 30. The outer vertical housing wall 32B has a diameter that is equivalent to the outer diameter of the air housing seat 64. The inner vertical housing wall 32A has a diameter that is equivalent to the diameter of the upper circular exit 92 of the fuel channel inlet zone 36. The inner housing wall 32A has a height that is less than the height of the outer housing wall 32B. However, because the inner housing wall 32A resides on the upper circular exit 92 of the fuel inlet zone and the outer housing wall 32B resides on the top surface of the lower air housing seat 64, the top edge of the inner housing wall 32A is elevated in relation to the top edge of the outer housing wall 32B. The inner housing wall 32A has a diameter that is less than the diameter of the outer housing wall 32B, the inner housing wall 32A has a diameter substantially equivalent to the diamaeter of the upper circular exit 92 of the fuel channel inlet zone 36.

The annular space between the inner housing wall 32A and the outer housing wall 32B defines an annular air channel 68 in the air housing 30. In FIGS. 1 and 2, the annular air channel 68 receives air from the air supply passage 56 and distributes it around the periphery of the air housing 30. The top of the annular air channel 68 is defined by a combustion plate 38. The combustion plate 38 includes a flat surface that connects the upper edge of the inner housing wall 32A and the upper edge of the outer housing wall 32B. Because of the differences in the elevation of the inner housing wall 32A and the outer housing wall 32B, the combustion plate 38 slopes down from the inner housing wall 32a to the outer housing wall 32B. The combustion plate 38 includes evenly-spaced radial slots 60 in its surface, providing communication between the top of the combustion plate 38 and the annular air channel 68.

Again referring to FIGS. 1, 2 and 3, the inner housing wall 32A defines a vertical, circular fuel channel 28 that communicates between the fuel channel inlet zone 36 and a fuel discharge port 34 located on the top of the fuel channel 28. Thus, the fuel discharge port 34, fuel channel 28, fuel channel inlet zone 36, and the fuel outlet zone 16 in combination communicate between the combustion plate 38 and the inside surface of the conveyor casing 12.

Figure 4:
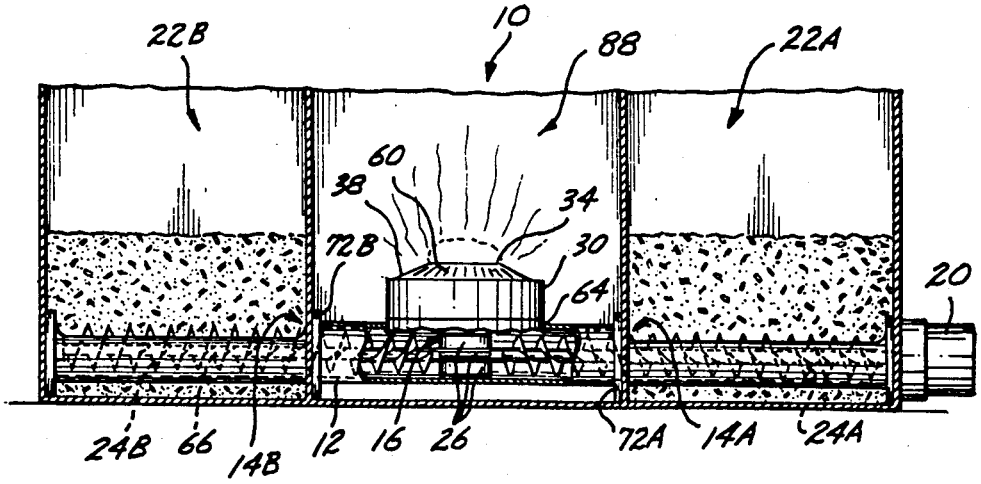
FIG. 4 illustrates an environmental view of the stoker assembly in accordance with the present invention with a portion of the casing cut-away.

In FIG. 1, the auger 18 is removed from the conveyor casing 12. Additionally, in FIG. 3, the auger 18 includes a longitudinal auger shaft 66 that includes first 24A and second 24B helical flights of opposite hand. The opposing ends of the first and second helical flights 24A and 24B of the auger shaft 66 communicate with individual fuel supplies 22A and 22B shown in FIG. 4. In FIGS. 1, 3, and 4, the adjacent ends of the first and second helical flights 24A and 24B remote from the fuel inlets 14A and 14B are spaced apart. Between the adjacent ends of the helical flights 24A and 24B mounted on the auger shaft 66 are four longitudinal fuel directing paddles 26. The fuel directing paddles 26 are rectangular members that extend in a direction outward from the auger shaft 66. The fuel directing paddles 26 are positioned longitudinally around the circumference of the auger shaft at 90° in relation to each other. The paddles 26 extend outward from the auger shaft 66 a distance that does not inhibit the rotatable motion of the auger 18 within the conveyor casing 12. In FIG. 2, the fuel directing paddles 26 extend outward from the auger shaft 66 a distance that places the leading edge of the fuel directing paddles 26 adjacent to the conveyor casing 12. The length of the fuel directing paddles 26 is less than the diameter of the fuel channel 28.

In FIGS. 1 and 2, a fuel guide 40 directly below the fuel channel 28 extends in a forward direction orthogonal to the rear wall of the jacket 44. The fuel guide 40 includes a rounded leading edge 46 connecting a lower boundary 48 and an upper boundary 50. The lower boundary 48 of the fuel guide 40 is defined by the inner diameter of the conveyor casing 12. The upper boundary 50 is a flat, horizontal surface that extends orthogonally from the bottom of the rear wall of the fuel channel inlet zone 36. In FIG. 3, the upper boundary 50 and the leading edge 48 of the fuel guide are vertically positioned slightly above the top edge of the uppermost fuel directing paddle 26. The fuel guide 40 has first and second vertical sides 82A and 82B. In FIG. 3, the width of the fuel guide 40 is defined by the first and second vertical sides 82A and 82B and is equivalent to the length of the fuel directing paddles 26. In an alternative design (not shown), the ends of the helical flights 24A and 24B are joined and the fuel directing paddles 26 are omitted, the width of the fuel guide 40 is defined as being less than the diameter of the upper circular exit 92 of the fuel channel inlet zone 36. Adjacent the first and second vertical sides 82A and 82B of the fuel guide 40 are first and second fuel passages 84A and 84B intermediate the first and second sides 82A and 82B of the fuel guide 40 and the inside surface of the lower rectangular entry 90 of the fuel channel inlet zone 36.

Referring primarily to FIG. 2, the leading edge 46 of the fuel guide 40 extends into the fuel outlet zone 16 a distance that is limited by the vertical plane passing through the axial centerline 52 of the auger shaft 66. The leading edge 46 of the fuel guide 40 provides a surface that causes the fuel being directed in the direction of the arrow 42 by the fuel directing paddles 26 to pass above the upper boundary 50 of the fuel guide 40. The upper boundary 50 of the fuel guide 40 is a flat horizontal ledge, that prevents the fuel above the fuel guide 40 from passing downward back into the fuel directing paddles 26 or the ends of the helical flights 24A and 24B. By not allowing the fuel to repeatedly contact the fuel directing paddles 26 or the ends of the helical flights 24A and 24B, it is possible to reduce the degree that such particles are ground into smaller particles. As the particles reach the fuel channel inlet zone 36 above the upper boundary 50 of the fuel guide 40, they pass upward and into the fuel channel 28 and out the upper discharge port 34 onto the combustion plate 38 where air is supplied through slotted air vents 60 in the combustion plate 38. Combustion air is supplied to the annular air channel 68 through the air supply passage 56 that enters the annular air channel 68 through the outer wall 32B of the air housing 30.

Referring primarily to FIG. 4, the auger 18 is driven by an auger drive 20 on one end of the auger shaft 66 that is remote from the fuel outlet zone 16. The auger drive 20 may be of the type conventionally used in the art such as an electric motor. The remote ends of the auger 18 reside in the bottom of preferably airtight fuel bins 22A and 22B that contain fuel to be burned on the combustion plate 38. A portion of the casing 12 residing in the fuel bins 22A and 22B has been removed, thus allowing the fuel supply to fill the helical flights 24A and 24B of the auger 18 and be transported to the fuel outlet zone 16. Rotation of the auger drive 20 causes fuel to be transported to the interior fuel outlet zone 16 adjacent the ends of the auger 18 that are remote from the fuel bins 22A and 22B. In FIG. 3, the fuel passes through the conveyor casing 12 and exits the conveyor casing 12 at the fuel outlet 16 zone adjacent the ends of the helical flights 24A and 24B. Fuel accumulates in the fuel outlet zone 18 and is driven upward by the rotation of the fuel directing paddles 26 that are positioned on the auger shaft 66 as described hereinbefore. In FIG. 2, the fuel is directed by the fuel directing paddles 26 in the direction of the arrow 42. As the fuel reaches a position defined by the uppermost reach of the fuel directing paddles 26 it comes into contact with the rounded leading edge 46 of the fuel guide 40 protruding from the rear of the jacket 44 that supports the air housing seat 64. The leading edge 46 diverts the fuel upward and over the flat horizontal upper boundary 50 of the fuel guide 40. Some of the fuel that has been transported above the fuel guide 40 passes upward onto the combustion plate 38 by the force provided by the fuel in the lower fuel outlet zone 16.

Referring to FIG. 3, some of the fuel above the fuel guide 40 may fall around the first and second sides 82A and 82B of the fuel guide 40 back into the first and second helical flights 24A and 24B of the auger 18. Therein, the fuel is again transported to the central fuel directing paddles 26 that direct the fuel to the top of the fuel guide 40 once again. In FIG. 3, because the fuel guide 40 has a width substantially equivalent to the length of the fuel directing paddles 26, fuel above the fuel guide 40 may not pass directly downward back into the fuel directing paddles 26. Rather, the fuel must fall downward around the fuel guide 40 and fuel directing paddle 26, into the helical flights 24A and 24B. This reduces the degree that the fuel is ground into small particles by the repeated action of the fuel directing paddles 26.

Referring primarily to FIG. 4, the stoker assembly 10 is positioned within a combustion chamber 88 intermediate first and second fuel bins 22A and 22B. The fuel bins 22A and 22B provide fuel to the auger 18 that is driven by the auger drive 20 positioned on an external end of the auger shaft 66 outside the fuel bins 22a and 22B. The fuel is transported to the interior ends of the first and second helical flights 24A and 24B directly below the combustion plate 38. Therein, the fuel directing paddles 16 cause the fuel to be transported upwardly through the air housing 30 and out the top discharge port 34 onto the combustion plate 38 where the fuel is burned.

Figure 5:
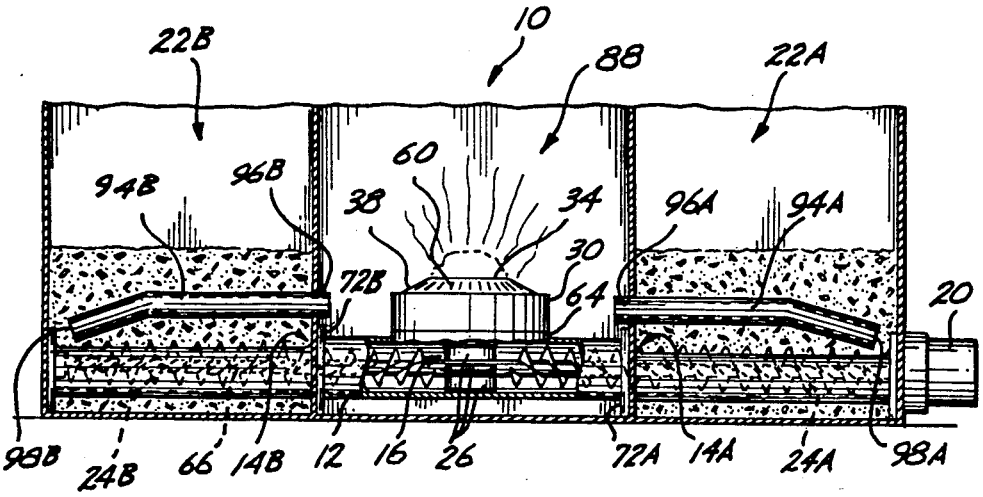
FIG. 5 illustrates an environmental view of the stoker assembly including the channel in accordance with the present invention with a portion of the casing cut-away.

Referring primarily to FIG. 5, the stoker assembly 10 includes channels 94A and 94B that are generally longitudinal ventilation tubes communicating between the respective fuel storage bins 22A and 22B and the combustion chamber 88. The channels 94A and 94B have first ends 96A and 96B that communicate with the combustion chamber 88 and second ends 98A and 98B that communicate with the respective fuel storage bins 22A and 22B. The channels 98A and 98B are generally positioned parallel to and above the horizontal auger shaft 66 with first ends 96A and 96B just below the plane of the combustion plate 38. The second ends 98A and 98B are slanted downward so their outlet is proximate the top of the helical flights 24A and 24B. In order to minimize the back flow of any smoke or combustion gases into the fuel bins 22A and 22B, the channels 94A and 94B are preferably positioned as close as possible to the horizontal plane defined by the auger shaft 20. Another means of reducing the flow of hot gases, sparks or flames through the channels 94A and 94B is to provide an induced draft blower (not shown) that slightly depressurizes the combustion chamber 88. This type of induced draft blower can be provided by situating and directing a conventional blower downstream of the combustion plate 38.

The channels 94A and 94B serve to equilibrate the pressures in the combustion chamber 88 and the fuel bins 22A and 22B by allowing each fuel bin 22A and 22B to communicate with the combustion chamber 88, thus any pressure change in the combustion chamber 88 results in an equal change in the pressure of the fuel bins 22A and 22B. Because an important factor in preventing the "burn back" to the fuel bins 22A and 22B through the conveyor casing 12 is reducing the amount of oxygen available for combustion, equilibrating the pressure between the fuel bins 22A and 22B and the combustion chamber 88 reduces the driving force that causes combustion air to flow through the conveyor casing 12. Ideally, except for the communication with the conveyor casing 12 and the channels 94A and 94B, the fuel bins 22A and 22B are airtight which enhances the pressure equilibrating effect of the channels 94A and 94B by excluding ambient air; however, even where the fuel bins 22A and 22B are not perfectly airtight, the channels 94A and 94B still reduce the pressure difference along the conveyor casing 12.

The cross-sectional are of the channels 94a and 94B is dependent on the size of the fuel conveyor casing 12 and the degree of airtight sealing in the fuel bins 22A and 22B. Although not intending to be limited to any particular sizes, it has been found that channels 94A and 94B with cross-sectional areas of at least 25% of the cross-sectional are of the conveyor casing 12 provide adequate control of the burn back danger when the are through which air may enter or escape the fuel bins 22A and 22B is as much as 25% of the cross-sectional area of the channels 94A and 94B. Of course, if the area available for air to escape or enter the fuel bins 22A and 22B is greater, the cross-sectional area of the channels 94A and 94B should accordingly be increased.

The stoker assembly may be made from materials that are compatible with the combustion of particulate fuel within an enclosed chamber. Preferably, the materials are of metallic compositions, most preferably the metallic composition is cast iron. The particular choice of material will be dependent upon cost factors, heat and corrosion resistance, and machinability.

The fuel that is burned by the stoker assembly of the present invention may be any type of pelletized fuel known in the art. Examples of such fuel include pelletized wood waste, agricultural residue, paper, coal dust, or garbage and the like. Preferably the pelletized fuel is wood.

Although the present invention has been described in a specific form and as operating in a specific manner for the purpose of illustration, it is to be understood that the invention is not limited thereto. Various modifications will suggest themselves to those skilled in the art without departing from the spirit of this invention, the scope of which is set forth in the following claims.

The embodiments of the invention in which an exclusive property or privilege is claimed are defined as follows:

1. A stoker assembly for a soild particulate fuel burning stove comprising:

(a) a fuel conveyor means having a casing, first and second fuel inlets adjacent each end of the casing; a fuel outlet zone intermediate the inlets, a rotatably driven auger means disposed within the casing to move fuel from the first and second fuel inlets to the fuel outlet zone, the auger means including a first helical flight and a second helical flight of opposite hand, the first helical flight intermediate the first fuel inlet and the fuel outlet zone and the second helical flight intermediate the second fuel inlet and the fuel outlet zone;

(b) fuel directing means proximate the ends of the first helical flight and the second helcial flight opposite the first and second fuel inlets;

(c) an air housing having an inner wall defining a vertical fuel channel for passage of fuel from a lower fuel channel inlet zone through the fuel channel to a combustion plate at the top of the air housing, the fuel channel inlet zone communicates between the fuel outlet zone of the casing and the fuel channel; and (d) fuel guiding means including a member for directing a portion of the fuel in the fuel outlet zone of the casing into the fuel channel inlet zone, the fuel guiding means includes a flange disposed on the interior surface of the casing at the interface between the fuel outlet zone of the casing and the fuel channel inlet zone, the fuel guiding means extends from the casing in a direction opposite the fuel flow created by the fuel directing means.

2. The stoker assembly of claim 1, wherein the maximum distance that the leading edge of the fuel guiding means extends into the fuel outlet zone is defined by a vertical plane passing through the axial centerline of the auger means.

3. The stoker assembly of claim 1, wherein the solid particulate fuel is selected from the group consisting of pelletized wood waste, agricultural residue, paper, coal dust, and garbage.

4. The stoker assembly of claim 1, wherein the fuel directing means includes the joined ends of the first and second helical flights opposite the first and second fuel inlets.

5. The stoker assembly of claim 1, wherein the fuel directing means includes spaced-apart adjacent ends of the helical flights in the fuel outlet zone with fuel directing paddles located intermediate the adjacent ends of the first and second helical flights.

6. The stoker assembly of claim 1, wherein the fuel guiding means has a rounded leading edge connecting a lower boundary defined by the inner diameter of the casing wall and a flat horizontal upper boundary in contact with the interior wall of the fuel channel inlet zone.

7. The stoker assembly of claim 6, wherein the fuel guiding means directs a substantial portion of the fuel in the fuel outlet zone of the casing into the fuel channel.

8. The stoker assembly of claim 6, wherein the fuel guiding means has a width equivalent to the length of the fuel directing paddles.

9. The stoker assembly of claim 6, wherein the fuel guiding means has a width that is less than the diameter of the fuel channel.

10. The stoker assembly of claim 9, wherein the fuel guiding means is positioned below the fuel channel.

* * * * *

UNITED STATES PATENT AND TRADEMARK OFFICE

CERTIFICATE OF CORRECTION

PATENT NO. : 4,787,322

DATED : November 29, 1988

INVENTOR(S) : Oliver J. Whitfield

It is certified that error appears in the above-identified patent and that said Letters Patent is hereby corrected as shown below:

| Column | Line | |
|---|---|---|
| 2 | 22 | "incudes" should be --includes-- |
| 3 | 17 | "set" should be --seat-- |
| 3 | 22 | "the" should be --The-- |
| 3 | 39 | "set" should be --seat-- |
| 7 | 33 | "are" should be --area-- |
| 7 | 34 | "are" should be --area-- |

Signed and Sealed this

Eighth Day of August, 1989

*Attest:*

*Attesting Officer*

DONALD J. QUIGG

*Commissioner of Patents and Trademarks*